US008866677B2

(12) United States Patent
Cheng et al.

(10) Patent No.: US 8,866,677 B2
(45) Date of Patent: Oct. 21, 2014

(54) BROADBAND PLANAR INVERTED-F ANTENNA

(75) Inventors: Shih-Chieh Cheng, Kaohsiung (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 285 days.

(21) Appl. No.: 13/559,407

(22) Filed: Jul. 26, 2012

(65) Prior Publication Data

US 2013/0154884 A1 Jun. 20, 2013

(30) Foreign Application Priority Data

Dec. 15, 2011 (TW) ..... 100146643 A

(51) Int. Cl.
*H01Q 1/38* (2006.01)
*H01Q 1/24* (2006.01)

(52) U.S. Cl.
CPC . *H01Q 1/38* (2013.01); *H01Q 1/243* (2013.01)
USPC ..... 343/700 MS; 343/702

(58) Field of Classification Search
CPC ..... H01Q 1/243; H01Q 1/38; H01Q 13/20
USPC ..... 343/700 MS, 702, 846
See application file for complete search history.

(56) References Cited

U.S. PATENT DOCUMENTS 6,049,314 A * 4/2000 Munson et al. ..... 343/846
6,246,368 B1 * 6/2001 Deming et al. ..... 343/700 MS
2010/0090912 A1 * 4/2010 Lin et al. ..... 343/702
2010/0123631 A1 * 5/2010 Chang et al. ..... 343/700 MS

* cited by examiner

*Primary Examiner* — Hoanganh Le
(74) *Attorney, Agent, or Firm* — Rabin & Berdo, P.C.

(57) ABSTRACT

A broadband planar inverted-F antenna includes a first radiation conductor, a second radiation conductor and a third radiation conductor. The first radiation conductor includes a first inclined-plane portion and a feeding point. The feeding point is located at one end of the first inclined-plane portion. The second radiation conductor is connected to the first radiation conductor at the feeding point. The third radiation conductor is connected to the first radiation conductor, and includes a second inclined-plane portion and a ground point. The second inclined-plane portion is separated from and facing to the first inclined-plane portion. The ground point is located at one end of the second inclined-plane portion and facing to the feeding point, wherein the distance between the first inclined-plane portion and the second inclined-plane portion is gradually increased from the part near the feeding point along a direction departing from the feeding point.

28 Claims, 14 Drawing Sheets

| data | 1 | 2 | 3 | 4 | 5 |
|---|---|---|---|---|---|
| frequency | 2.4GHz | 2.45GHz | 2.5GHz | 4.9GHz | 5.85GHz |
| VSWR | 1.9455 | 1.3470 | 2.1907 | 1.6480 | 2.1 |

| data | 1 | 2 | 3 | 4 | 5 |
|---|---|---|---|---|---|
| frequency | 2.4GHz | 2.45GHz | 2.5GHz | 4.9GHz | 5.85GHz |
| VSWR | 2.2067 | 1.2802 | 1.3346 | 1.5026 | 1.5 |

BROADBAND PLANAR INVERTED-F ANTENNA

This application claims the benefit of Taiwan application Serial No. 100146643, filed Dec. 15, 2011, the subject matter of which is incorporated herein by reference.

BACKGROUND OF THE INVENTION

1. Field of the Invention

The invention relates in general to a broadband planar inverted-F antenna (PIFA), and more particularly to a dual-band and broadband planar inverted-F antenna built in thin frame TV.

2. Description of the Related Art

Wireless communication has gained booming development in recent years. In response to the trend of miniaturization in many communication products, the antenna needs to be down-sized and possess an embedded architecture so as to provide an aesthetic appearance to the products. In comparison to the monopole antenna and the inverted-F antenna, the planar inverted-F antenna has the advantages of smaller size and bigger. Through suitable design with the radiation conductor, the planar inverted-F antenna is able to receive dual-band and multi-band wireless signal and has been widely used in signal reception for wireless electronic products such as mobile phone.

In recent years, the digital TV (DTV) is further combined with wireless module to receive wireless signals conformed to 802.11a/b/g/n protocols of the wireless local area network (WLAN). In general, the WLAN has two signal bands, namely, 2.4 GHz~2.5 GHz and 4.9 GHz~5.85 GHz. However, under the miniaturizing and thinning trend of TV screen, if the wireless module still uses the planar inverted-F antenna to receive WLAN dual-band signals, the requirements of slimness and big bandwidth cannot be both satisfied. Therefore, how to provide a dual-band planar inverted-F antenna having the features of slimness and big bandwidth at the same time has become a prominent task for the development of digital TV using WLAN communication.

SUMMARY OF THE INVENTION

The invention is directed to a broadband planar inverted-F antenna. An indented structure is formed in a planar radiation conductor of the broadband planar inverted-F antenna for generating a travelling wave radiation after signals are fed to the antenna. The distance between two opposite sides of the indented structure is gradually increased from an opening of the indented structure towards the closed base of the indented structure for increasing the signal bandwidth of the travelling wave radiation. Therefore, small-sized and thin planar inverted-F antenna, which is closely appressed to the thin frame of TV screen and satisfying the big bandwidth required by the WLAN communication, can thus be provided.

According to a first aspect of the present invention, a broadband planar inverted-F antenna is disclosed. The broadband planar inverted-F antenna includes a first radiation conductor, a second radiation conductor and a third radiation conductor. The first radiation conductor includes a first inclined-plane portion and the feeding point. The feeding point is located at one end of the first inclined-plane portion. The second radiation conductor is connected to the first radiation conductor at the feeding point, so that the antenna of the invention has a first operating frequency band. The third radiation conductor is connected to the first radiation conductor, and includes a second inclined-plane portion and a ground point. The second inclined-plane portion is separated from and facing to the first inclined-plane portion. The ground point is located at one end of the second inclined-plane portion and facing to the feeding point to form an opening. The distance between the first inclined-plane portion and the second inclined-plane portion is gradually increased from the part near the feeding point along a direction departing from the feeding point, and at last closes at the connection between the first radiation conductor and the third radiation conductor. The distance between the first inclined-plane portion and the second inclined-plane portion is gradually increased, so that the antenna of the invention has a second operating frequency band.

According to a second aspect of the present invention, a broadband planar inverted-F antenna is disclosed. The broadband planar inverted-F antenna includes a first radiation conductor and a second radiation conductor. The first radiation conductor includes an indented structure, a feeding point and a ground point. The distance between two opposite sides of the indented structure is gradually increased from an opening of the indented structure towards the closed base of the indented structure. The feeding point is located at one side of the opening of the indented structure for receiving a radio frequency signal. The ground point is located at the other side of the opening of the indented structure and facing to the feeding point. After radio frequency signals are fed to the antenna via the feeding point, the indented structure generates a travelling wave radiation to form a second operating frequency band. The second radiation conductor is connected to the first radiation conductor at the part near the feeding point. After radio frequency signals are fed to the antenna via the feeding point, the second radiation conductor generates a resonance standing wave radiation to form a first operating frequency band. The frequency of the second operating frequency band is higher than that of the first operating frequency band.

The above and other aspects of the invention will become better understood with regard to the following detailed description of the preferred but non-limiting embodiment(s). The following description is made with reference to the accompanying drawings.

Figure 5A:
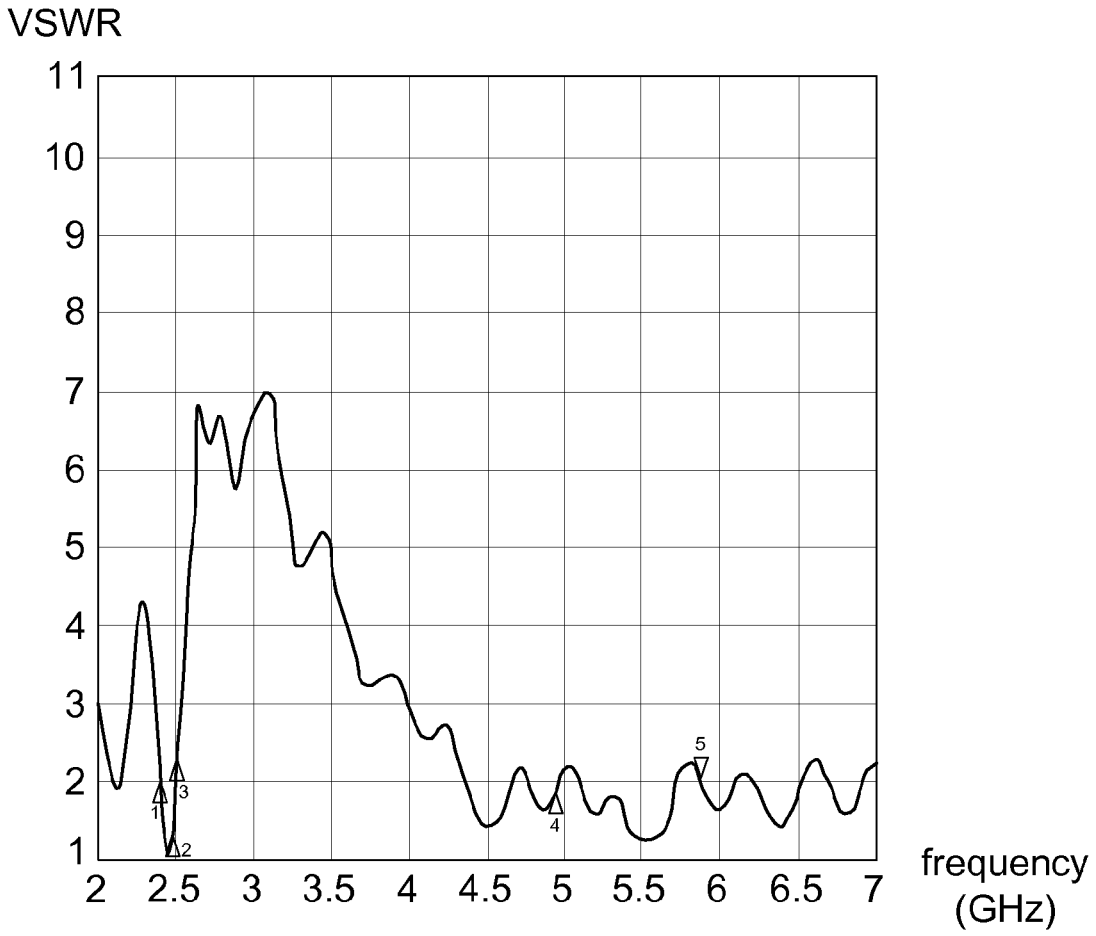
Figure 5B:
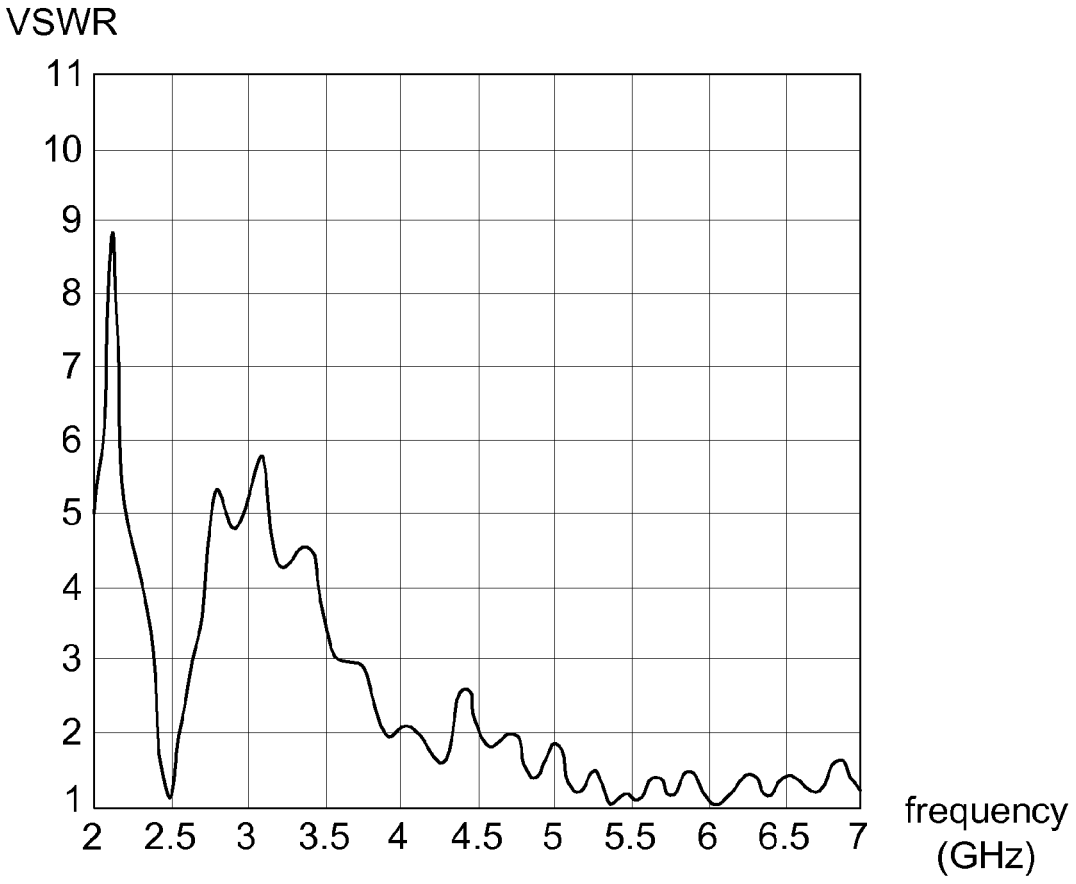

GHz, 5.25 GHz, 5.35 GHz, 5.47 GHz, 5.725 GHz, 5.825 GHz and 5.85 GHz according to an exemplary embodiment of the invention;

FIGS. 5A~5B respectively show return loss measurement diagrams of a broadband planar inverted-F antenna disposed at the first position and the second position on the frame of TV screen according to an exemplary embodiment of the invention.

DETAILED DESCRIPTION OF THE INVENTION

The invention is directed to a dual-band broadband planar inverted-F antenna. A radiation arm and an indented structure are formed in a planar radiation conductor of the planar inverted-F antenna for generating a resonance standing wave radiation and a travelling wave radiation respectively after signals are fed to the antenna. The distance between two opposite sides of the indented structure is gradually increased from an opening of the indented structure towards the closed base of the indented structure for increasing the signal bandwidth of the travelling wave radiation. Therefore, a thin planar inverted-F antenna, which has big bandwidth and can be built on the thin frame of TV screen and satisfy the bandwidth requirement in WLAN communication, can thus be provided.

Figure 1A:
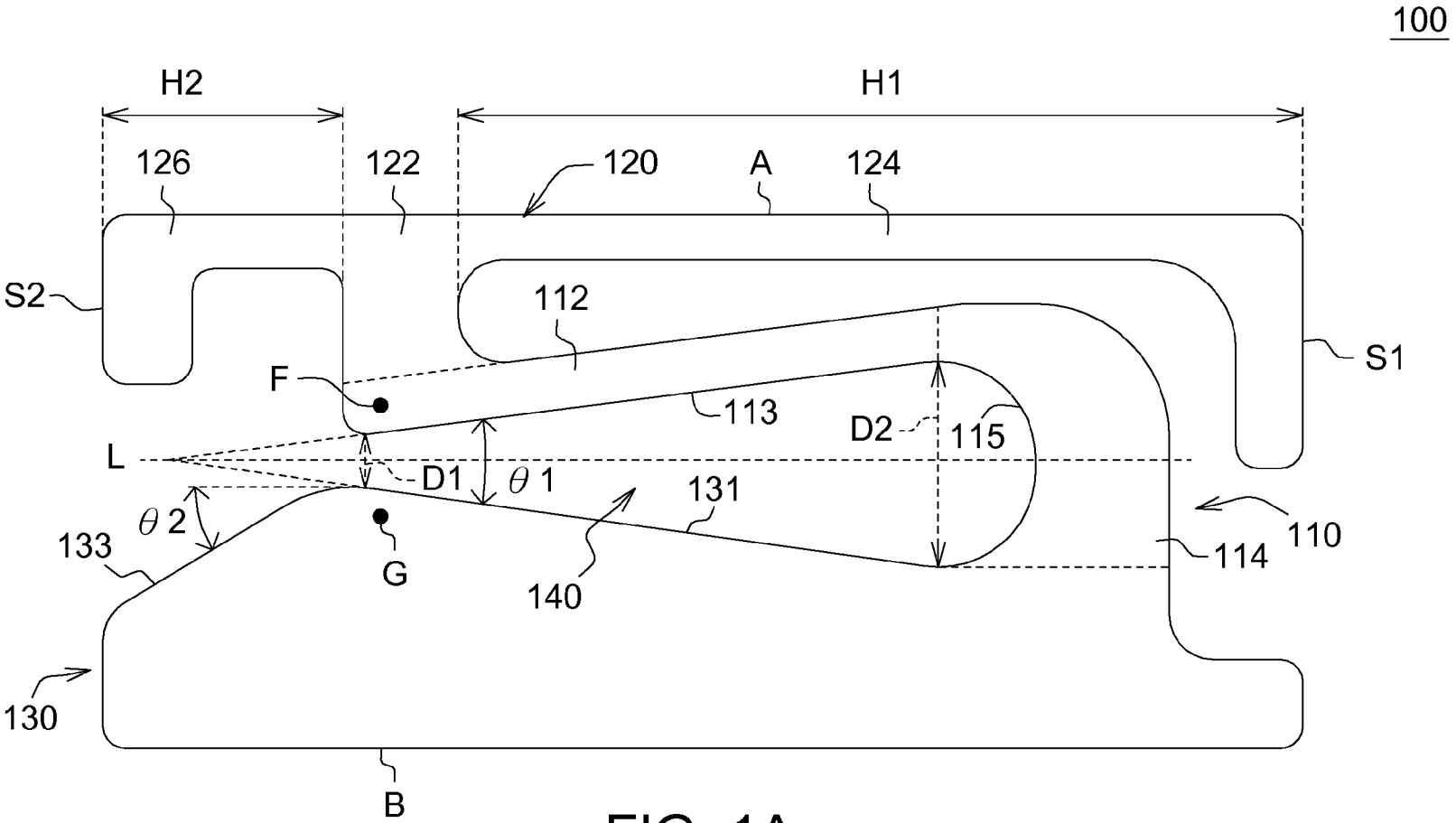
FIG. 1A shows a structural diagram of a broadband planar inverted-F antenna according to an exemplary embodiment of the invention.
Figure 1B:
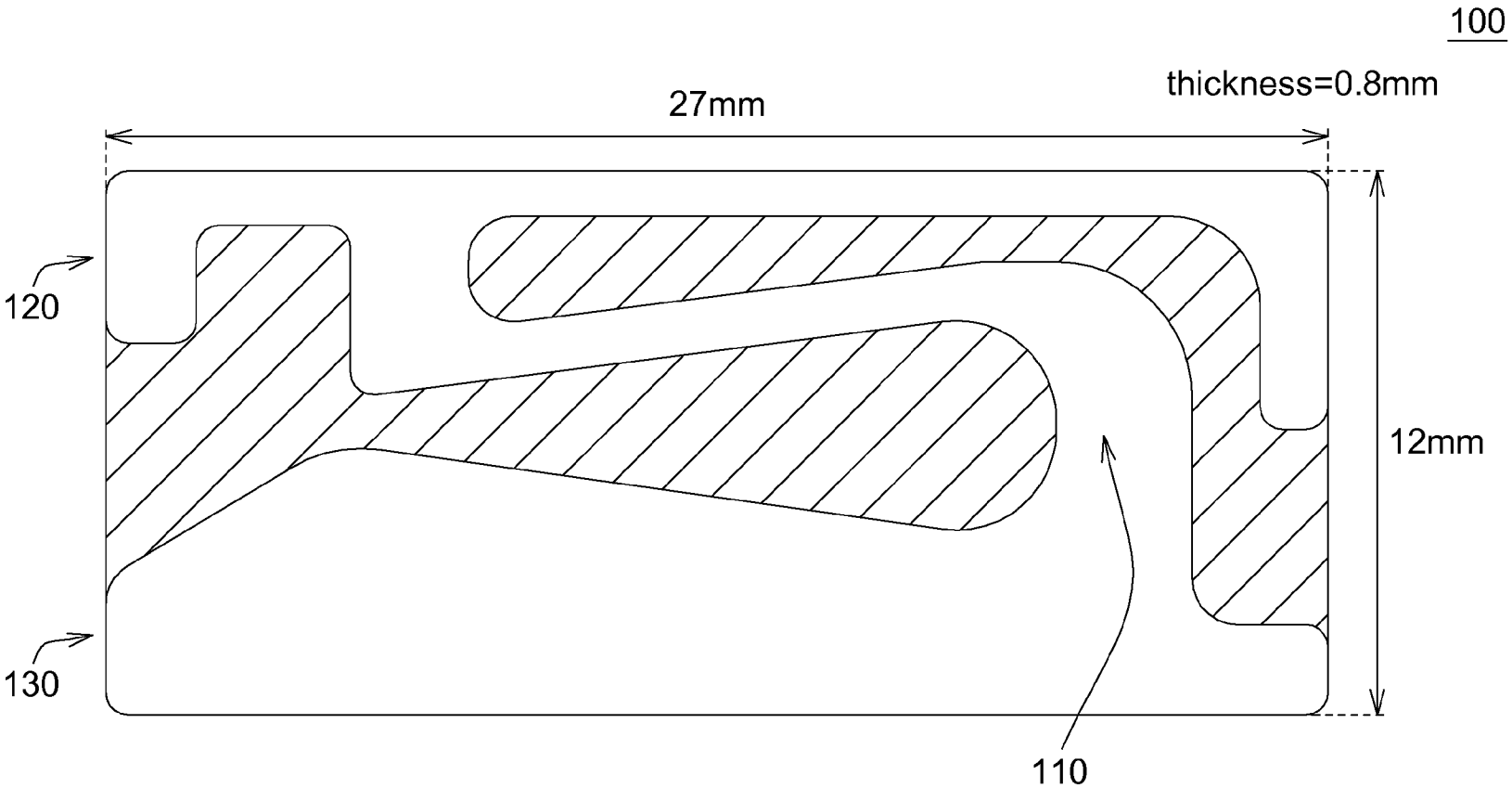
FIG. 1B shows a schematic diagram of a broadband planar inverted-F antenna using a hollowed part of a rectangular metal plate according to an exemplary embodiment of the invention.

Referring to FIG. 1A, a structural diagram of a broadband planar inverted-F antenna according to an exemplary embodiment of the invention is shown. The planar inverted-F antenna 10 is closely appressed to the thin frame of a digital TV screen for receiving wireless signals from a WLAN. The planar inverted-F antenna 100 is such as a metal planar conductor structure. As indicated in FIG. 1A, the planar conductor structure of the planar inverted-F antenna 100 at least includes a first radiation conductor 110, a second radiation conductor 120 and a third radiation conductor 130. The first radiation conductor 110 is connected between the second radiation conductor 120 and the third radiation conductor 130. The radiation conductors 110, 120 and 130 can be integrally formed in one piece. As indicated in FIG. 1B, the planar inverted-F antenna 100 is formed by hollowing the slashed region of a 27 mm×12 mm×0.8 mm rectangular metal plate.

The first radiation conductor 110 includes a connection portion 112 and a bending portion 114. The connection portion 112 includes a first inclined-plane portion 113 and a feeding point F. The feeding point F is located at one end of the first inclined-plane portion 113. One end of the connection portion 112 is connected to the second radiation conductor 120. The bending portion 114 is connected between the other end of the connection portion 112 and the third radiation conductor 130 for offsetting the stress generated due to the distortion of the broadband planar inverted-F antenna 100 to avoid the antenna being broken. The bending portion 114 has an arc-shaped portion 115 connected to the first inclined-plane portion 113.

The second radiation conductor 120 is connected to the first radiation conductor 110 at the feeding point F. The second radiation conductor 120 includes a radiation pillar 122, a first radiation arm 124 and a second radiation arm 126. The radiation pillar 122 is connected to the connection portion 112 of the first radiation conductor 110. The first radiation arm 124 and the second radiation arm 126 respectively are connected to two opposite sides of the radiation pillar 122, wherein the first radiation arm 124 and the first radiation conductor 110 are located on the same side of the radiation pillar 122. In addition, both the first radiation arm 124 and the second radiation arm 126 are an L-shaped arm, wherein the side arms of the two L-shaped arm connected to the radiation pillar 122 are parallel to each other. The length H1 of the first radiation arm 124 is larger than the length H2 of the second radiation arm 126. The distance between the connection portion 112 and the first radiation arm 124 is gradually decreased from the radiation pillar 122 along the bending portion 114.

Moreover, the third radiation conductor 130 includes a second inclined-plane portion 131, a third inclined-plane portion 133 and a ground point G. The second inclined-plane portion 131 is connected to the arc-shaped portion 115, and is separated from and facing to the first inclined-plane portion 113. The ground point G is located at one end of the second inclined-plane portion 131 and opposite to the feeding point F. The feeding point F and the ground point G are connected to a co-axial transmission line (not illustrated in FIG. 1A) for receiving a radio frequency signal and connecting to a ground potential respectively. The distance between the first inclined-plane portion 113 and the second inclined-plane portion 131 is gradually increased from the part near the feeding point G along a direction departing from the feeding point G (that is, towards the bending portion 114). The minimum distance D1 between the first inclined-plane portion 113 and the second inclined-plane portion 131 is the distance between two top ends of the inclined-plane portions 113 and 131 near the feeding point G. The maximum distance D2 between the first inclined-plane portion 113 and the second inclined-plane portion 131 is the distance between two top ends of the inclined-plane portions 113 and 131 connected to the bending portion 114.

In the present embodiment, the minimum distance D1 is 1 mm, and the maximum distance D2 is 5 mm. The angle θ1 contained between first inclined-plane portion 113 and the second inclined-plane portion 131 is between 20~60 degrees.

Moreover, the third inclined-plane portion 133 is connected to the second inclined-plane portion 131, the ground point G is located at the junction between the third inclined-plane portion 133 and the second inclined-plane portion 131, and the third inclined-plane portion 133 and the second radiation arm 126 are located on the same side of the radiation pillar 122.

In the present embodiment, the first inclined-plane portion 113, the arc-shaped portion 115 and the second inclined-plane portion 131 form an indented structure 140, the first inclined-plane portion 113 and the second inclined-plane portion 131 are two opposite sides of the indented structure 140, and the arc-shaped portion 115 is the closed base of the indented structure 140. The feeding point F and the ground point G respectively are located at two sides of the opening of the indented structure 140, and the minimum distance D1 between the first inclined-plane portion 113 and the second inclined-plane portion 131 is the dimension of the opening of the indented structure 140. Preferably, the first inclined-plane portion 113 and the second inclined-plane portion 131 are symmetric with respect to a center line L of the indented structure 140, and the arc-shaped portion 115 is a round arc and is symmetric with respect to the center line L. The center line L is parallel to the lateral side A of the second radiation conductor 120 and the lateral side B of the third radiation conductor 130. The angle θ2 contained between the third inclined-plane portion 133 and the center line L (that is, the bisector of the angle θ1) is between 30~45 degrees.

Figure 2A:
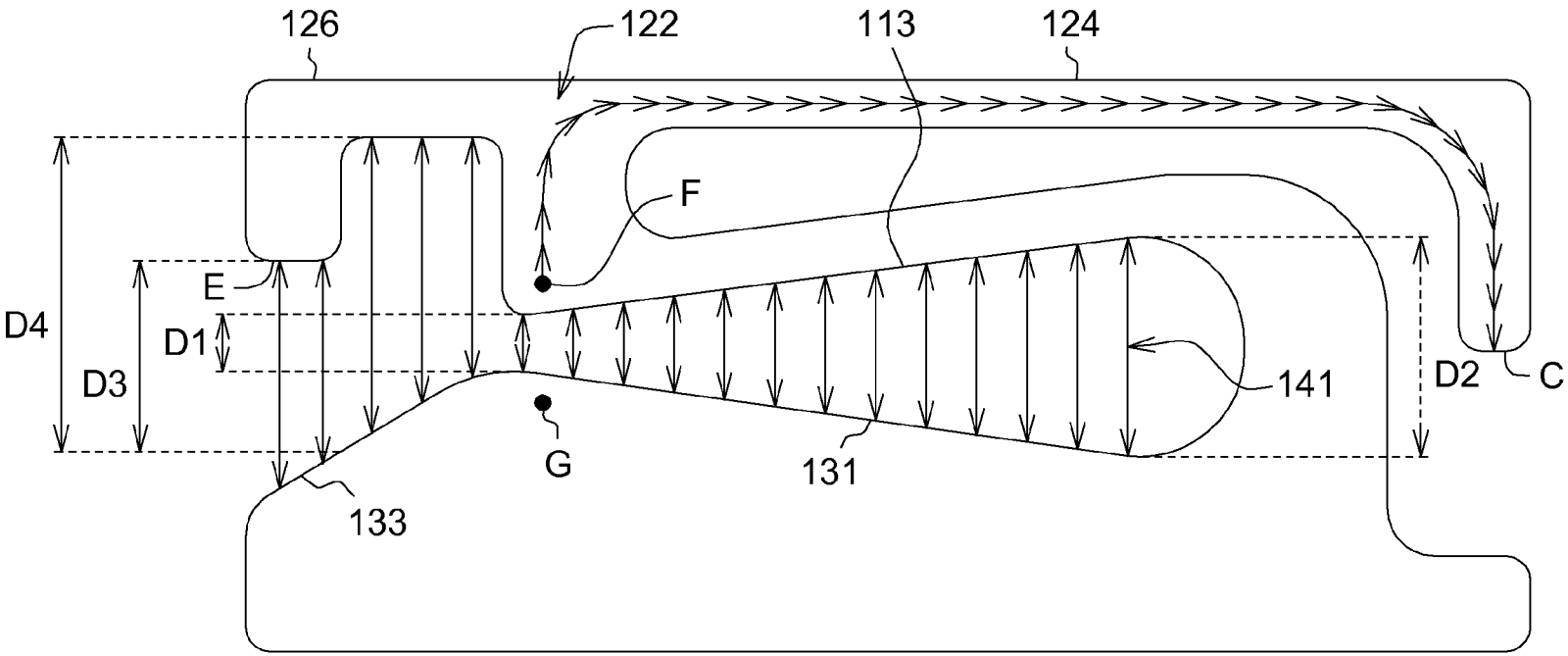
FIG. 2A shows a schematic diagram of two types of radiation excited by the broadband planar inverted-F antenna of FIG. 1A.

Referring to FIG. 2A, a schematic diagram of two types of radiation excited by the broadband planar inverted-F antenna 100 of FIG. 1A is shown. After radio frequency signals are fed to the antenna via the feeding point G, the radiation pillar 122 and the first radiation arm 124 generate a current flowing to the top end C of the first radiation arm 124. The current will excite a resonance standing wave radiation having a first operating frequency band whose center frequency is determined by the total length of the current path flowing to the top end C from the feeding point F. The first operating frequency band is such as a 2.4 GHz~2.5 GHz frequency band required in the WLAN communication.

The main feature of the present embodiment lies in the design of the first inclined-plane portion 113 and the second inclined-plane portion 131 of the indented structure 140. After radio frequency signals are fed to the antenna via the feeding point G, the first inclined-plane portion 113, the arc-shaped portion 115 and the second inclined-plane portion 131 of the indented structure 140 generate charge change, such that the first travelling wave radiation 141 are excited between the first inclined-plane portion 113 and the second inclined-plane portion 131. After radio frequency signals are fed to the antenna via the feeding point G, the radiation pillar 122, the second radiation arm 126 and the third inclined-plane portion 133 generate charge change, such that the second travelling wave radiation 142 is excited between the second radiation arm 126 and the third inclined-plane portion 133. The first travelling wave radiation 141 and the second travelling wave radiation 141 form a broadband travelling wave radiation having a second operating frequency band whose center frequency is determined by the total length of the current path flowing to the top end E of the second radiation arm 126 from the feeding point F. The second operating frequency band is such as a 4.9 GHz~5.85 GHz frequency band required in the WLAN communication.

Since the distance between the first inclined-plane portion 113 and the second inclined-plane portion 131 is gradually increased from the opening of the indented structure 140 towards the closed base (that is, the arc-shaped portion 115) of the indented structure 140, the radio frequency of the first travelling wave radiation 141 will be gradually decreased from the minimum distance D1 towards the maximum distance D2, and such decrease in radio frequency is conducive to increasing the bandwidth of travelling wave radiation 141. For example, the minimum distance D1 corresponds to the maximum frequency of the first travelling wave radiation 141, that is, the maximum frequency 5.85 GHz of the broadband travelling wave radiation, and the maximum distance D2 corresponds to the minimum frequency 5 GHz of the travelling wave radiation 141.

In addition, the second travelling wave radiation 142 generated by the second radiation arm 126 and the third inclined-plane portion 133 is further conducive to increasing the bandwidth of the broadband travelling wave radiation. The minimum distance between the second radiation arm 126 and the third inclined-plane portion 133, that is, the minimum distance D3 between the top end E and the third inclined-plane portion 133, is smaller than the maximum distance D2 between the first inclined-plane portion 113 and the second inclined-plane portion 131. The maximum distance between the second radiation arm 126 and the third inclined-plane portion 133, that is, the maximum distance D4 between the inner lateral side of the second radiation arm 126 and the third inclined-plane portion 133, is larger than the maximum distance D2 between the first inclined-plane portion 113 and the second inclined-plane portion 131. The maximum distance D4 determines the minimum frequency 4.9 GHz of the broadband travelling wave radiation. Thus, the first radiation arm 124, the second radiation arm 126, the indented structure 140 and the third inclined-plane portion 133 can be formed by the planar metal conductor for generating a dual-band broadband planar inverted-F antenna, which is thin and has big bandwidth and can be built in the thin frame of the digital TV screen for receiving WLAN signals.

In the above embodiment, the indented structure 140 includes a first inclined-plane portion 113, a second inclined-plane portion 131 and a bending portion 114 with an arc-shaped portion 115. The two opposite lateral sides of the indented structure 140 can be non-planar such as curvature-shaped or arc-shaped, and the closed base of the indented structure can be non-arc-shaped such as planar or curvature-shaped. Any designs allowing the distance between two opposite lateral sides of the indented structure to be gradually increased from the opening of the indented structure towards the base of the indented structure and allowing the bending portion 114 to be connected between the connection portion 112 and the third radiation conductor 130 for offsetting the stress generated due to the distortion of the planar inverted-F antenna are within the scope of protection of the invention.

In other embodiments, the third inclined-plane portion 133 of the third radiation conductor 130 can be non-planar such as curvature-shaped or arc-shaped. Any design of the third radiation conductor 130 which generates travelling wave radiation with the second radiation arm 126 and can be combined with the travelling wave radiation generated by the indented structure 140 to form a big bandwidth radiation frequency band is within the scope of protection of the invention.

Figure 2B:
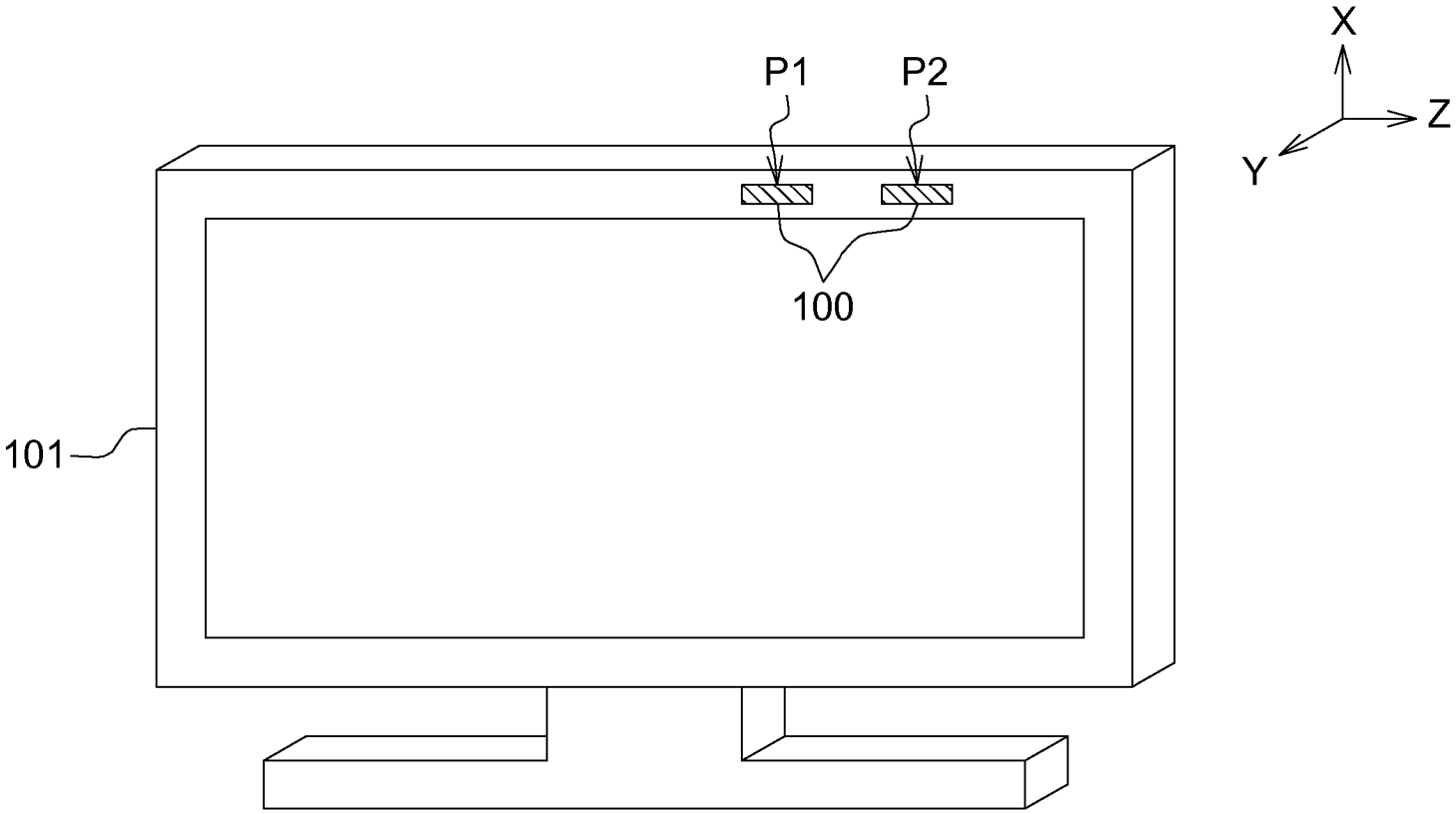
FIG. 2B shows a schematic diagram of the broadband planar inverted-F antenna of FIG. 1A apprised at two different positions on the top right side on the frame of TV screen.
Figure 3A:
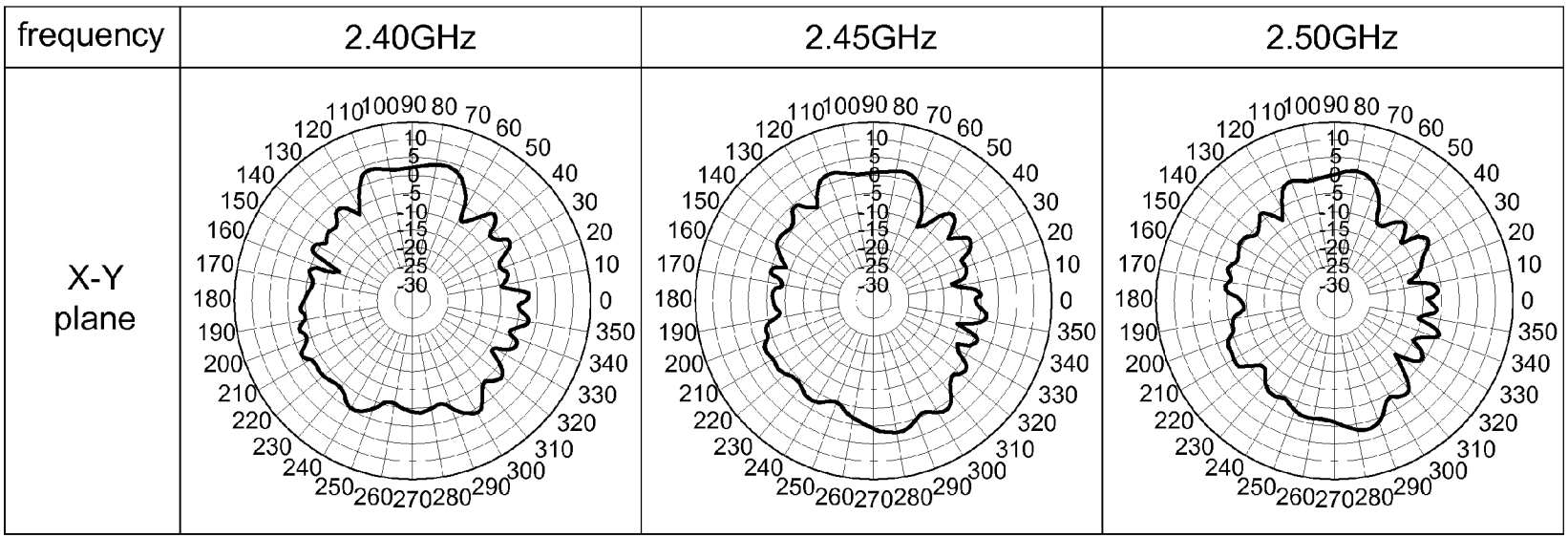
FIGS. 3A~3D respectively show x-y plane radiation field patterns of a broadband planar inverted-F antenna disposed at a first position on the frame of TV screen under the frequencies of 2.40 GHz, 2.45 GHz, 2.50 Hz, 4.90 GHz, 5.15 GHz, 5.25 GHz, 5.35 GHz, 5.47 GHz, 5.725 GHz, 5.825 GHz and 5.85 GHz according to an exemplary embodiment of the invention.
Figure 3B:
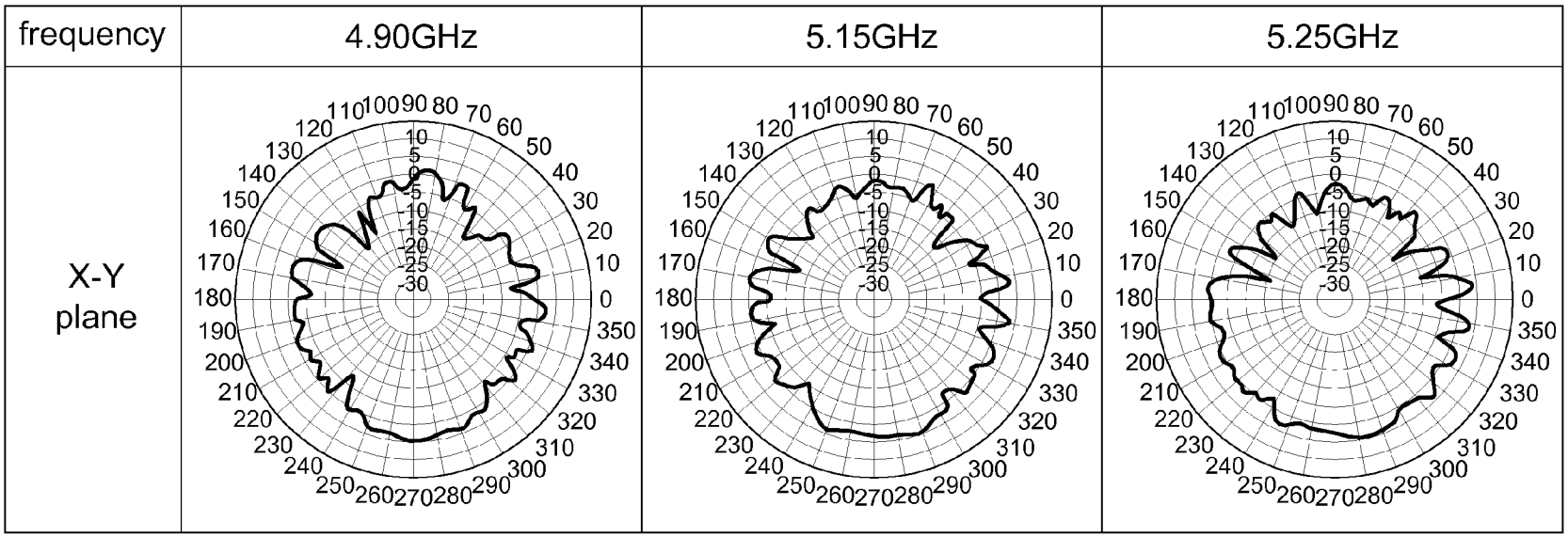
Figure 3C:
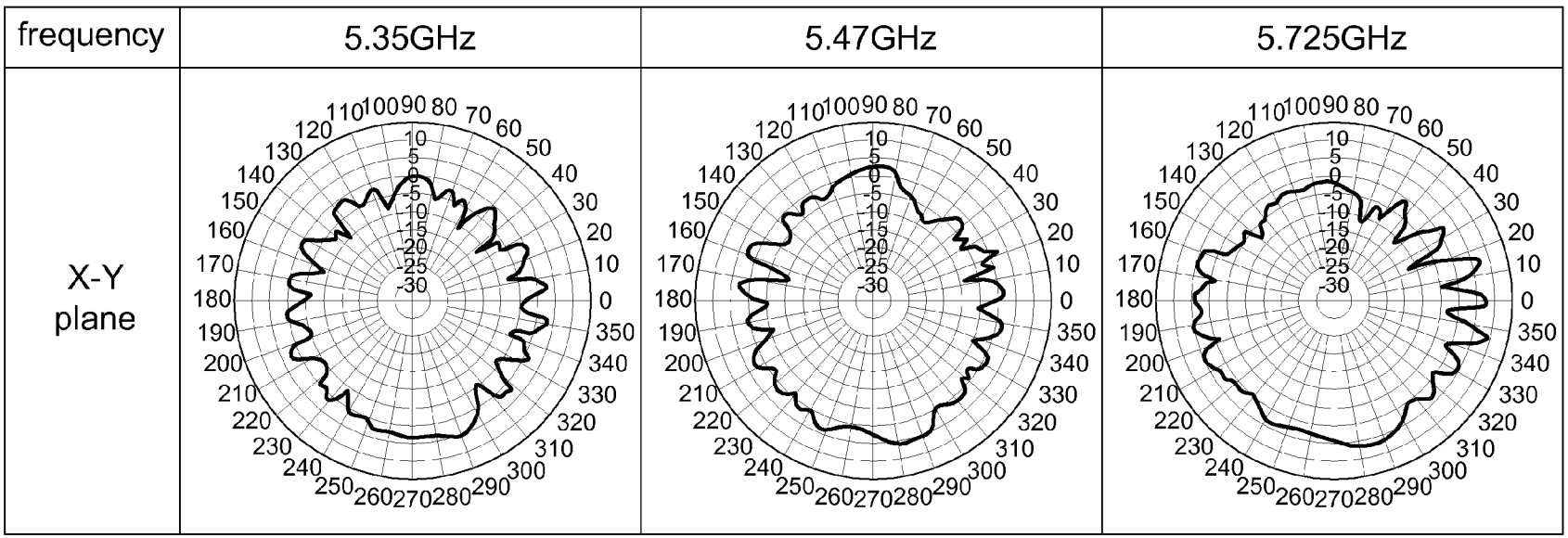
Figure 3D:
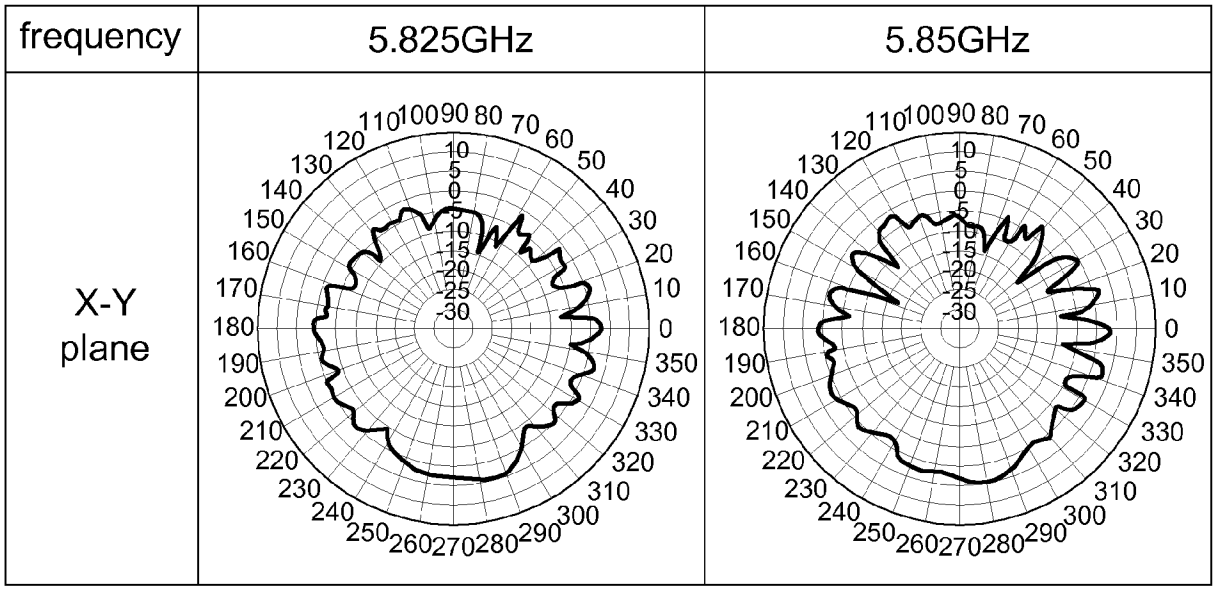
Figure 4A:
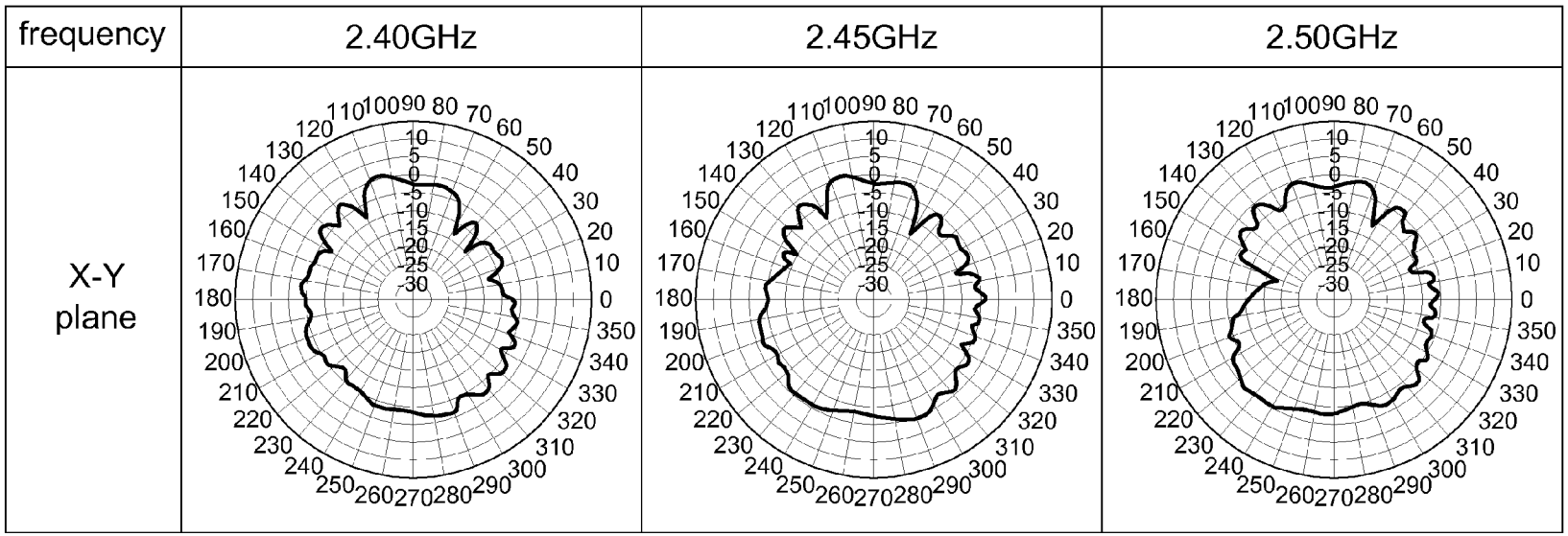
FIGS. 4A~4D respectively show x-y plane radiation field patterns of a broadband planar inverted-F antenna disposed at a second position on the frame of TV screen under the frequencies of 2.40 GHz, 2.45 GHz, 2.50 Hz, 4.90 GHz, 5.15
Figure 4B:
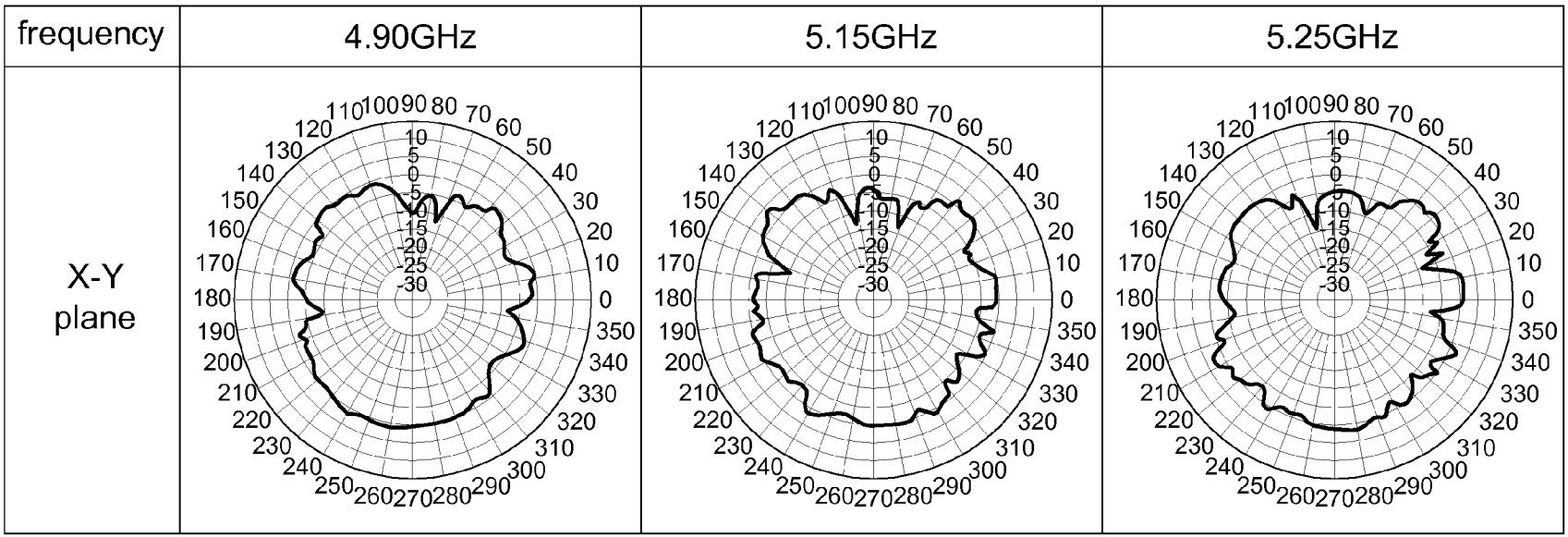
Figure 4C:
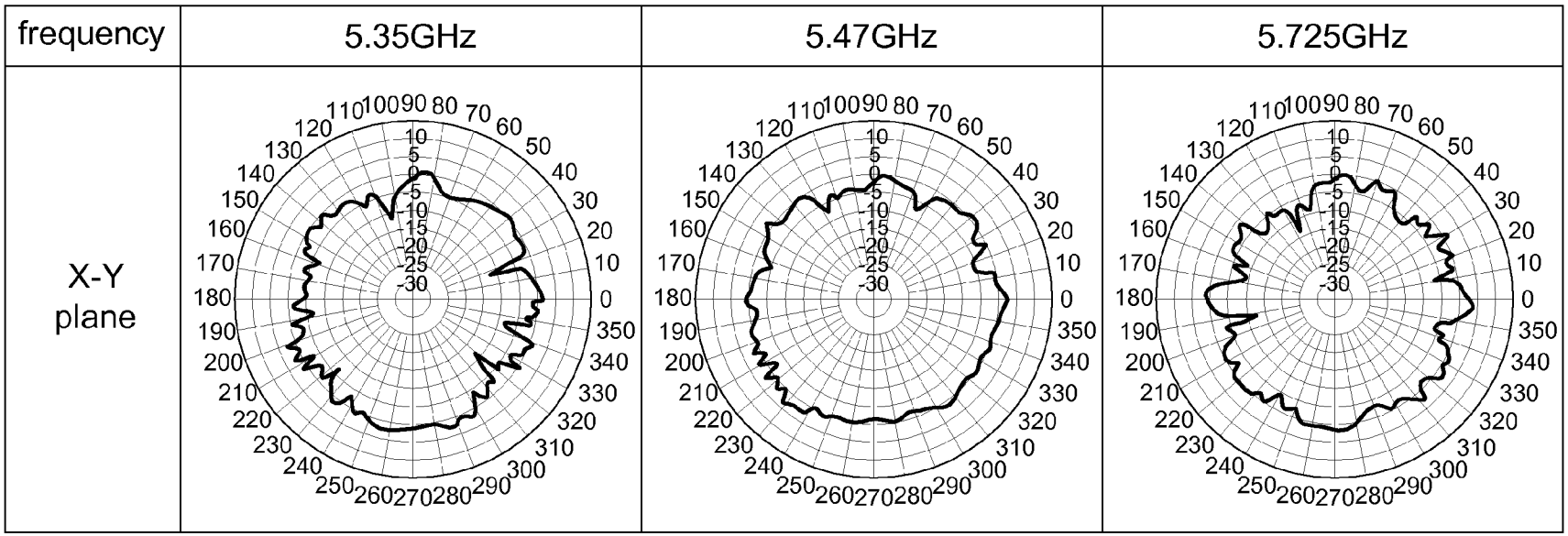
Figure 4D:
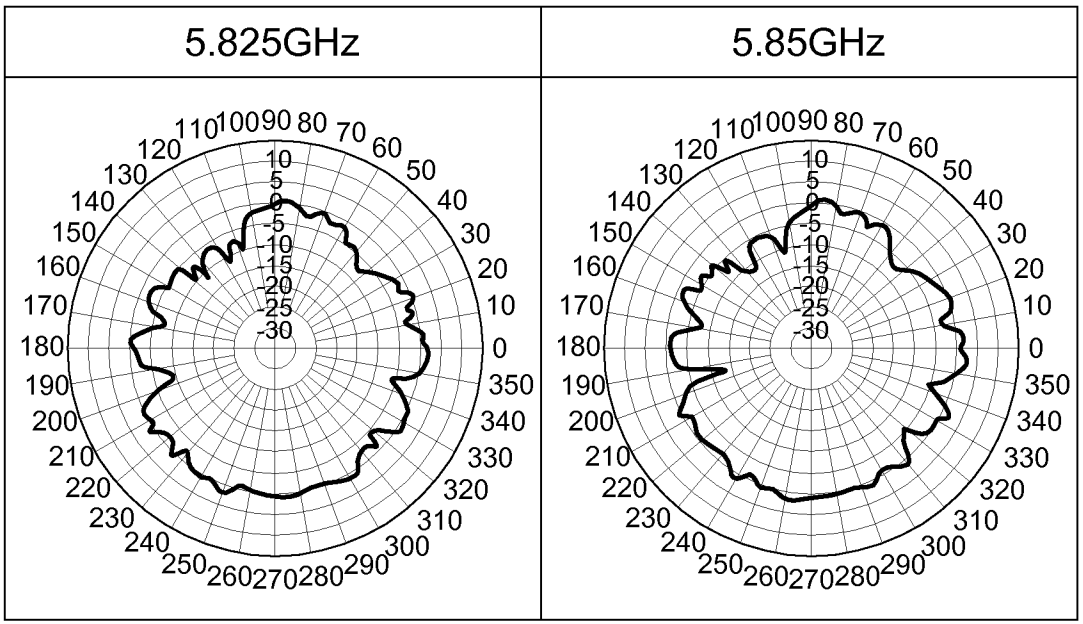

Next, the broadband planar inverted-F antenna 100 of the present embodiment is closely appressed to the first position P1 or the second position P2 at the top right of the TV screen frame 101 (as indicated in FIG. 2B) to test the radiation field patterns on the x-y plane generated by different frequencies. The planar radiation conductor of the planar inverted-F antenna 100 is parallel to the x-z plane. Referring to FIGS. 3A~3D, x-y plane radiation field patterns of a broadband planar inverted-F antenna 100 disposed at a first position P1 on the frame of TV screen under the frequencies of 2.40 GHz, 2.45 GHz, 2.50 Hz, 4.90 GHz, 5.15 GHz, 5.25 GHz, 5.35 GHz, 5.47 GHz, 5.725 GHz, 5.825 GHz and 5.85 GHz according to an exemplary embodiment of the invention are respectively shown. As indicated in FIGS. 3A~3D, under the frequency band used in WLAN communication, the field pattern generated on the x-y plane (perpendicular to TV screen) by the broadband planar inverted-F antenna 100 disposed at the first position P1 of TV screen frame is basically omni-directional radiation, which is particularly applicable to the broadband antenna in WLAN communication. Referring to FIGS. 4A~4D, x-y plane radiation field patterns of a broadband planar inverted-F antenna disposed at a second position on the frame of TV screen under the frequencies of 2.40 GHz, 2.45 GHz, 2.50 Hz, 4.90 GHz, 5.15 GHz, 5.25 GHz, 5.35 GHz, 5.47 GHz, 5.725 GHz, 5.825 GHz and 5.85 GHz according to an exemplary embodiment of the invention are respectively shown. As indicated in FIGS. 4A~4D, the broadband planar inverted-F antenna 100 is disposed at a second position P2 on the frame of TV screen, under the frequency band used in WLAN communication, the field pattern generated on the x-y plane (perpendicular to TV screen) by the broadband planar inverted-F antenna 100 disposed at the second position P2 of TV screen frame is basically omni-directional radiation, which is particularly applicable to the broadband antenna in WLAN communication.

Referring to FIGS. 5A~5B, return loss measurement diagrams of a broadband planar inverted-F antenna disposed at the first position P1 and the second position P2 on the frame of TV screen according to an exemplary embodiment of the invention are respectively shown. As indicated in FIG. 5A, the voltage standing wave ratios (VSWR) corresponding to the frequencies 2.4 GHz, 2.45 GHz, 2.5 GHz, 4.9 GHz and 5.85 GHz are respectively 1.9455, 1.3470, 2.1907, 1.6480 and 2.1. As indicated in FIG. 5B, the VSWR corresponding to the frequencies 2.4 GHz, 2.45 GHz, 2.5 GHz, 4.9 GHz and 5.85 GHz are respectively 2.2067, 1.2802, 1.3346, 1.5206 and 1.5. FIGS. 5A and 5B show that when the broadband planar inverted-F antenna 100 disposed at different positions P1 and P2 on the frame of TV screen is used under frequency bands 2.4 GHz~2.5 GHz and 4.9 GHz~5.85 GHz conforming to 802.11a/b/g/n WLAN communication protocols, the resulted VSWR is below 2.5.

Referring to Table 1, peak and average gains measured on the x-y plane when the broadband planar inverted-F antenna disposed at the first position P1 and the second position P2 on the frame of TV screen is used under different frequencies.

TABLE 1

| | Frequency (GHz) | 2.4 | 2.45 | 2.5 | 4.9 | 5.15 | 5.25 | 5.35 | 5.47 | 5.725 | 5.825 | 5.85 |
|---|---|---|---|---|---|---|---|---|---|---|---|---|
| P1 | Peak Gain (dBi) | 1.29 | 1.14 | −0.11 | 1.38 | 3.27 | 2.43 | 2.36 | 3.07 | 3.32 | 1.79 | 2.48 |
| | Average Gain (dBi) | −3.72 | −2.96 | −3.83 | −1.95 | −1.49 | −1.39 | −1.47 | −0.72 | −1.67 | −1.51 | −1.42 |
| P2 | Peak Gain (dBi) | 2.46 | 1.28 | 0.81 | 4.39 | 4.57 | 4.13 | 5.81 | 5.79 | 6.04 | 5.31 | 4.44 |
| | Average Gain (dBi) | −2.75 | −3.04 | −4.05 | −0.92 | −0.57 | −0.97 | −0.51 | 0.10 | −0.42 | −0.81 | −1.04 |

As indicated in Table 1, the average gain of the planar inverted-F antenna 100 under the frequency band of 2.4 GHz~2.5 GHz conforming to 802.11b/g/n protocol is larger than −4.05 dBi, and the average gain under the frequency band of 4.9 GHz~5.85 GHz conforming to 802.11a/n is larger than −1.95 dBi. Thus, when the planar inverted-F antenna 100 is used for receiving dual-band WLAN signals, the radiation efficiency requirement that the average gain must be larger than −6.5 dBi and the radiation requirement that the voltage standing wave ratio VSWR must be below 2.5 can both be satisfied. Furthermore, the planar inverted-F antenna 100 of the present embodiment has the features of slimness and big bandwidth, and is applicable to thin type digital TV combined with WLAN.

The broadband planar inverted-F antenna disclosed in the above embodiments of the invention provides WLAN 2.4 GHz~2.5 GHz frequency band radiation through the design of a first radiation arm, and provides WLAN 4.9 GHz~5.85 GHz frequency band radiation through the design of an indented structure, a second radiation arm and a third inclined-plane portion. The design allowing the distance between two opposite sides of the indented structure to be gradually increased from an opening of the indented structure towards the closed base of the indented structure is conducive to increasing the radiation bandwidth. Through the above design, the big bandwidth requirement of WLAN 4.9 GHz~5.85 GHz frequency band can be satisfied without having to increase the length of the antenna length or bend the body of the antenna, and an antenna having the features of slimness and big bandwidth can be provided and used in the thin type digital TV combined with the transmission of wireless signals in WLAN communication. Moreover, the broadband planar inverted-F antenna can be formed by hollowing parts of a metal plate, hence having the advantages of simplified manufacturing process and reduced manufacturing cost.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A broadband planar inverted-F antenna (PIFA), comprising:

a first radiation conductor, comprising:

a first inclined-plane portion; and a feeding point located at one end of the first inclined-plane portion;

a second radiation conductor connected to the first radiation conductor at the feeding point; and a third radiation conductor connected to the first radiation conductor, the third radiation conductor comprises:

a second inclined-plane portion separated from and facing to the first inclined-plane portion; and a ground point located at one end of the second inclined-plane portion and facing to the feeding point, wherein the distance between the first inclined-plane portion and the second inclined-plane portion is gradually increased from the part near the feeding point along a direction departing from the feeding point.

2. The broadband planar inverted-F antenna according to claim 1, wherein the second radiation conductor further comprises:

a radiation pillar connected to the first radiation conductor; and a first radiation arm and a second radiation arm respectively connected to two opposite sides of the radiation pillar, wherein the first radiation arm and the first radiation conductor are located on the same side of the radiation pillar.

3. The broadband planar inverted-F antenna according to claim 2, wherein both the first radiation arm and the second radiation arm are an L-shaped arms.

4. The broadband planar inverted-F antenna according to claim 2, wherein the length of the first radiation arm is larger than that of the second radiation arm.

5. The broadband planar inverted-F antenna according to claim 2, wherein the third radiation conductor further comprises a third inclined-plane portion connected to the second inclined-plane portion, and the third inclined-plane portion and the second radiation arm are located on the same side of the radiation pillar.

6. The broadband planar inverted-F antenna according to claim 5, wherein after radio frequency signals are fed to the antenna via the feeding point, a first travelling wave radiation is generated between the first inclined-plane portion and the second inclined-plane portion, a second travelling wave radiation is generated between the second radiation arm and the third inclined-plane portion, and the first travelling wave radiation and the second travelling wave radiation form a broadband travelling wave radiation.

7. The broadband planar inverted-F antenna according to claim 6, wherein after the radio frequency signal is fed to the antenna via the feeding point, a resonance standing wave radiation is generated by the radiation pillar and the first radiation arm generate.

8. The broadband planar inverted-F antenna according to claim 6, wherein the minimum distance between the first inclined-plane portion and the second inclined-plane portion determines the maximum frequency of the broadband travelling wave radiation, and the maximum distance between the second radiation arm and the third inclined-plane portion determines the minimum frequency of the broadband travelling wave radiation.

9. The broadband planar inverted-F antenna according to claim 5, wherein the maximum distance between the second radiation arm and the third inclined-plane portion is larger than the maximum distance between the first inclined-plane portion and the second inclined-plane portion.

10. The broadband planar inverted-F antenna according to claim 5, wherein the first radiation conductor further comprises:

a connection portion connected to the second radiation conductor, wherein the connection portion comprises the first inclined-plane portion and the feeding point; and a bending portion connected between the connection portion and the third radiation conductor for offsetting the stress generated due to the distortion of the broadband planar inverted-F antenna, wherein the bending portion has an arc-shaped portion connected between the first inclined-plane portion and the second inclined-plane portion.

11. The broadband planar inverted-F antenna according to claim 10, wherein the distance between the connection portion and the first radiation arm is gradually decreased from the radiation pillar towards the bending portion.

12. The broadband planar inverted-F antenna according to claim 5, wherein the angle contained between the third inclined-plane portion and the angle bisector of the first inclined-plane portion and the second inclined-plane portion is between 30~45 degrees.

13. The broadband planar inverted-F antenna according to claim 1, wherein the angle contained between the first inclined-plane portion and the second inclined-plane portion is between 20~60 degrees.

14. The broadband planar inverted-F antenna according to claim 1, being integrally formed in one piece.

15. A broadband planar inverted-F antenna, comprising:

a first radiation conductor, comprising:

an indented structure, wherein the distance between two opposite sides of the indented structure is gradually increased from an opening of the indented structure towards the indented structure;

a feeding point located at the opening of an opening of the indented structure for receiving a radio frequency signal; and a ground point located at the opening of an opening of the indented structure and facing to the feeding point, wherein after the radio frequency signal is fed to the antenna via the feeding point, a first travelling wave radiation is generated by the indented structure; and a second radiation conductor connected to the first radiation conductor at the feeding point, wherein after the radio frequency signal is fed via the feeding point, a resonance standing wave radiation is generated by the second radiation conductor.

16. The broadband planar inverted-F antenna according to claim 15, wherein the first radiation conductor further comprises:

a connection portion connected to the second radiation conductor, wherein the connection portion comprises a first inclined-plane portion, and the feeding point is located at one end of the first inclined-plane portion;

a bending portion connected to the connection portion, wherein the bending portion has an arc-shaped portion connected to the first inclined-plane portion; and a radiation portion connected to the bending portion, wherein the radiation portion comprises a second inclined-plane portion connected to the arc-shaped portion and separated from and facing to the first inclined-plane portion, the ground point is located at one end of the second inclined-plane portion, and the first inclined-plane portion, the arc-shaped portion and the second inclined-plane portion together form the indented structure.

17. The broadband planar inverted-F antenna according to claim 16, wherein the second radiation conductor further comprises:

a radiation pillar connected to the connection portion;

a first radiation arm and a second radiation arm respectively connected to two opposite sides of the radiation pillar, wherein the first radiation arm and the supporting portion are located on the same side of the radiation pillar.

18. The broadband planar inverted-F antenna according to claim 17, wherein both the first radiation arm and the second radiation arm are an L-shaped arm.

19. The broadband planar inverted-F antenna according to claim 17, wherein the length of the first radiation arm is larger than that of the second radiation arm.

20. The broadband planar inverted-F antenna according to claim 17, wherein the radiation portion further comprises a third inclined-plane portion, and the third inclined-plane portion and the second radiation arm are located on the same side of the radiation pillar.

21. The broadband planar inverted-F antenna according to claim 20, wherein after the radio frequency signal is fed to the antenna via the feeding point, the first travelling wave radiation is formed between the first inclined-plane portion and the second inclined-plane portion, a second travelling wave radiation is formed between the second radiation arm and the third inclined-plane portion, and the first travelling wave radiation and the second travelling wave radiation form a broadband travelling wave radiation.

22. The broadband planar inverted-F antenna according to claim 21, wherein the minimum distance between the first inclined-plane portion and the second inclined-plane portion determines the maximum frequency of the broadband travelling wave radiation, and the maximum distance between the second radiation arm and the third inclined-plane portion determines the minimum frequency of the broadband travelling wave radiation.

23. The broadband planar inverted-F antenna according to claim 20, wherein the angle contained between the third inclined-plane portion and the angle bisector of the first inclined-plane portion and the second inclined-plane portion is between 30~45 degrees.

24. The broadband planar inverted-F antenna according to claim 17, wherein after the radio frequency signal is fed to the antenna via the feeding point, the resonance standing wave radiation is generated by the radiation pillar and the first radiation arm.

25. The broadband planar inverted-F antenna according to claim 17, wherein the maximum distance between the second radiation arm and the third inclined-plane portion is larger than the maximum distance between the first inclined-plane portion and the second inclined-plane portion.

26. The broadband planar inverted-F antenna according to claim 17, wherein the distance between the connection portion and the first radiation arm is gradually decreased from the radiation pillar towards the bending portion.

27. The broadband planar inverted-F antenna according to claim 16, wherein the angle contained between the first inclined-plane portion and the second inclined-plane portion is between 20~60 degrees.

28. The broadband planar inverted-F antenna according to claim 16 being an integrally formed in one piece.

* * * * *